US010573282B1

(12) United States Patent
Chen

(10) Patent No.: US 10,573,282 B1
(45) Date of Patent: Feb. 25, 2020

(54) DRUM SUPPORTING LEG AND DRUM HAVING THE SAME

(71) Applicant: K.H.S. Musical Instrument Co., Ltd., New Taipei (TW)

(72) Inventor: Bo-Ting Chen, New Taipei (TW)

(73) Assignee: K.H.S. Musical Instrument Co., Ltd., New Taipei (TW)

( * ) Notice: Subject to any disclaimer, the term of this patent is extended or adjusted under 35 U.S.C. 154(b) by 0 days.

(21) Appl. No.: 16/243,277

(22) Filed: Jan. 9, 2019

(30) Foreign Application Priority Data

Sep. 28, 2018 (TW) ..... 107134321 A

(51) Int. Cl.
*G10D 13/00* (2006.01)
*G10D 13/02* (2020.01)

(52) U.S. Cl.
CPC ..... *G10D 13/026* (2013.01); *G10D 13/021* (2013.01); *G10D 13/027* (2013.01); *G10D 13/028* (2013.01)

(58) Field of Classification Search
CPC .. G10D 13/026; G10D 13/021; G10D 13/027; G10D 13/028
See application file for complete search history.

(56) References Cited

U.S. PATENT DOCUMENTS 4,252,047 A * 2/1981 Gauger ..... G10G 5/005 84/421
6,054,645 A * 4/2000 Gauger ..... G10D 13/065 84/411 R

* cited by examiner

*Primary Examiner* — Kimberly R Lockett
(74) *Attorney, Agent, or Firm* — Huffman Law Group, PC

(57) ABSTRACT

A supporting leg to support a drum includes a first rod, a second rod, and a third rod. A first angle-adjusting mechanism is provided between the first rod and the second rod to adjust a first angle between the first rod and the second rod. A second angle-adjusting mechanism is provided between the second rod and the third rod to adjust a second angle between the second rod and the third rod. The output sound of the drum can be adjusted by changing the first angle and the second angle.

8 Claims, 7 Drawing Sheets

DRUM SUPPORTING LEG AND DRUM HAVING THE SAME

CROSS-REFERENCE TO RELATED APPLICATIONS

The entire contents of Taiwan Patent Application No. 107134321, filed on Sep. 28, 2018, from which this application claims priority, are expressly incorporated herein by reference.

BACKGROUND OF THE INVENTION

1. Field of the Invention

The present invention relates to drum supporting legs with angle-adjusting configuration and drums having the drum supporting legs.

2. Description of Related Art

A tom-tom drum, named from the Anglo-Indian and Sinhala language, is a double-headed cylindrical drum with a size smaller than bass drum. A floor tom is a tom-tom drum, which usually stands on the floor on three legs and tends to produce a booming, resonant sound capable of varying in pitch.

Many factors affect the sound of the floor tom. For example, some floor tom legs are designed so that their foot can be twisted to expose either a metal point or a rubber foot. The contact of the rubber with the ground allows the sound of the floor tom to have a longer sustain.

In addition, the height of the floor tom also affects its sound. For example, U.S. Pat. No. 9,269,337 discloses a floor tom that is mounted on three floor tom-tom legs through three tom-tom mounting devices. Each tom-tom mounting device includes a memory lock and a floor tom-tom bracket arranged above the memory lock. The memory lock is fixed to a rod as a pole constituting the floor tom-tom leg, or detached from the rod by operating a wing nut. The fixing position of the memory lock in relation to the floor tom-tom leg is determined by a player such that the floor tom-tom can be set up on a floor at easy-to-play height and angle. On the other hand, the bracket is fixed to an outer peripheral surface of a shell in the vicinity of the lower hoop. Next, the floor tom-tom leg and a tubular portion of the memory lock are inserted into the bracket and fixed with the bracket.

However, in some performance situations, for example, when the drum is placed on a dead surface lacking an acoustic reverberation or in an environment where the reverberation is too long, the desired sound cannot be obtained by merely adjusting the height of the drum supporting leg, the tension of the drum, and the like.

SUMMARY OF THE INVENTION

In one general aspect, the present invention relates to drum supporting legs with angle-adjusting configuration and drums having the drum supporting legs.

According to an embodiment of this invention, a drum supporting leg is provided for supporting a drum and adjusting the sound of the drum, comprising a first rod, a second rod, and a third rod. The first rod includes a first end and a second end, and the first end of the first rod is connected to outside of a shell of the drum. The second rod includes a first end and a second end, and the first end of the second rod is rotatably coupled to the second end of the first rod such that the first end of the second rod is capable of rotating about the second end of the first rod. The third rod includes a first end and a second end, and the first end of the third rod is rotatably coupled to the second end of the second rod such that the first end of the third rod is capable of rotating about the second end of the second rod.

In one embodiment, the second end of the first rod is rotatably coupled to the first end of the second rod through a first angle-adjusting mechanism, which comprises a first kit and a second kit. The first kit comprises a first sleeve and a first annular structure, wherein the first sleeve receives a second end of the first rod and couples with the first annular structure, and an inner side of the first annular structure comprises a plurality of teeth provided at equal intervals. The second kit comprises a second sleeve and a second annular structure, wherein the second sleeve receives the first end of the second rod and couples with the second annular structure, an inner side of the second annular structure comprises a plurality of teeth provided at equal intervals, and the teeth of the first annular structure engage with the teeth of the second annular structure.

In one embodiment, the first annular structure and the second annular structure form a first accommodating space, and a first elastic member is provided in the first accommodating space, wherein the drum supporting leg further comprises a first fixing member passing through a center portion of the first annular structure and a center portion of the second annular structure to fix the first annular structure and the second annular structure.

In one embodiment, the first end of the third rod is rotatably coupled to the second end of the second rod through a second angle-adjusting mechanism, which comprises a third kit and a fourth kit. The third kit comprises a third sleeve and a third annular structure, wherein the third sleeve receives a second end of the second rod and couples with the third annular structure, and an inner side of the third annular structure comprises a plurality of teeth provided at equal intervals. The fourth kit comprises a fourth sleeve and a fourth annular structure, wherein the fourth sleeve receives the first end of the third rod and couples with the fourth annular structure, an inner side of the fourth annular structure comprises a plurality of teeth provided at equal intervals, and the teeth of the third annular structure engage with the teeth of the fourth annular structure.

In one embodiment, the third annular structure and the fourth annular structure form a second accommodating space, and a second elastic member is provided in the second accommodating space, and the drum supporting leg further comprises a second fixing member passing through a center portion of the third annular structure and a center portion of the fourth annular structure to fix the third annular structure and the fourth annular structure.

According to another embodiment of this invention, a drum is provided with a hollow cylindrical shell, an upper hoop, a lower hoop, an upper drumhead, a lower drumhead, a plurality of brackets, and a plurality of drum supporting legs. The hollow cylindrical shell includes an upper opening and a lower opening. The upper hoop couples an upper portion of the shell. The lower hoop couples a lower portion of the shell. The upper drumhead couples with the upper hoop and seals the upper opening of the shell. The lower drumhead couples with the lower hoop and seals the lower opening of the shell. The brackets are fixed to the outside of the shell. The drum supporting legs correspond to the brackets and at least one of the drum supporting leg is the above-mentioned drum supporting leg capable of adjusting an angle.

According to the drum supporting legs and drums provided by embodiments of the invention, the drummer can quickly and easily adjust the bending angle of the drum supporting leg to obtain a desired sound, and/or obtain a height that is easy to percuss.

DETAILED DESCRIPTION OF THE PREFERRED EMBODIMENT

Figure 1:
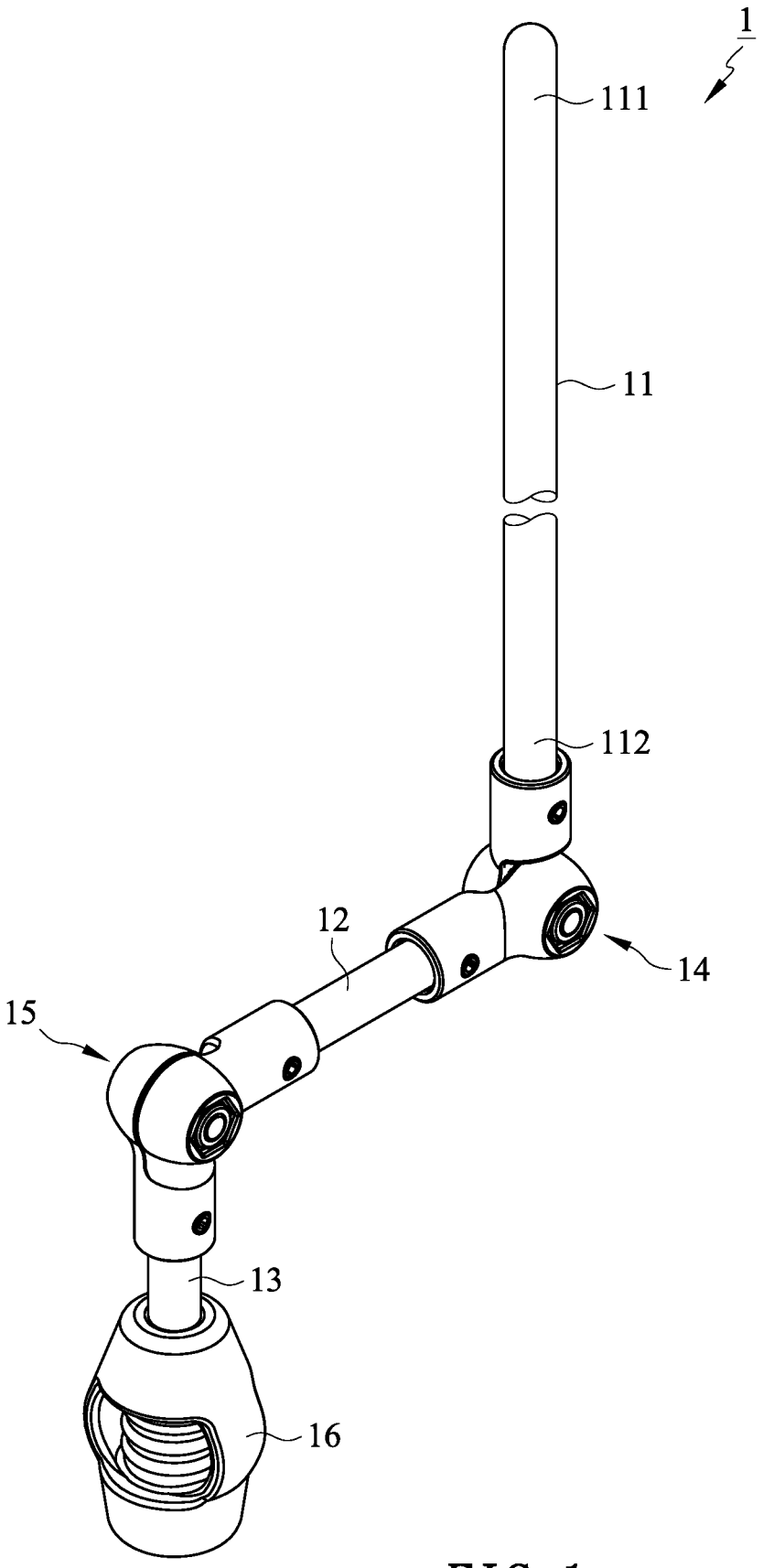
FIG. 1 is a perspective view of a drum supporting leg that provides an adjustable angle in accordance with a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
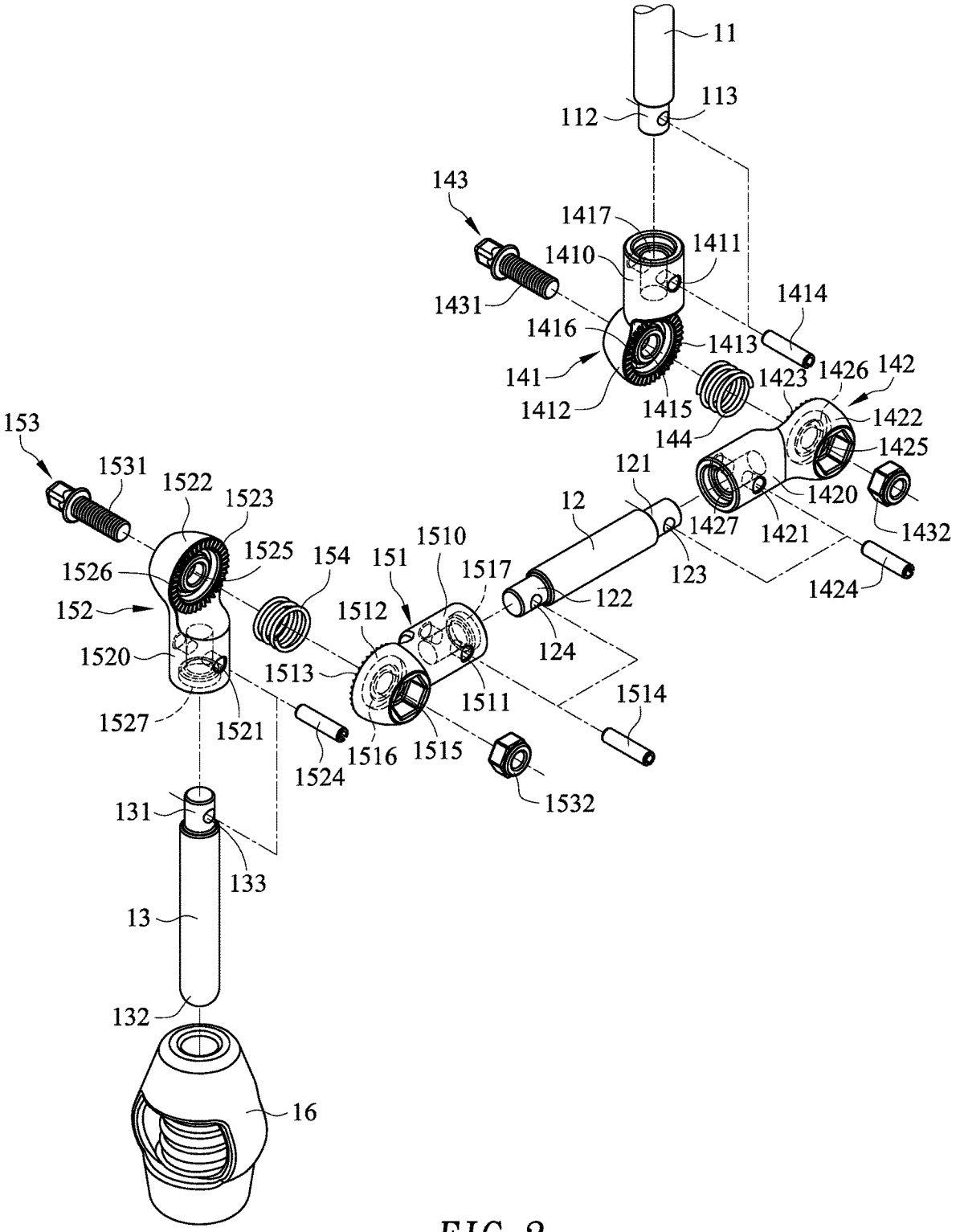
FIG. 2 is an exploded view of the drum supporting leg provided by the preferred embodiment of the present invention.
Figure 3:
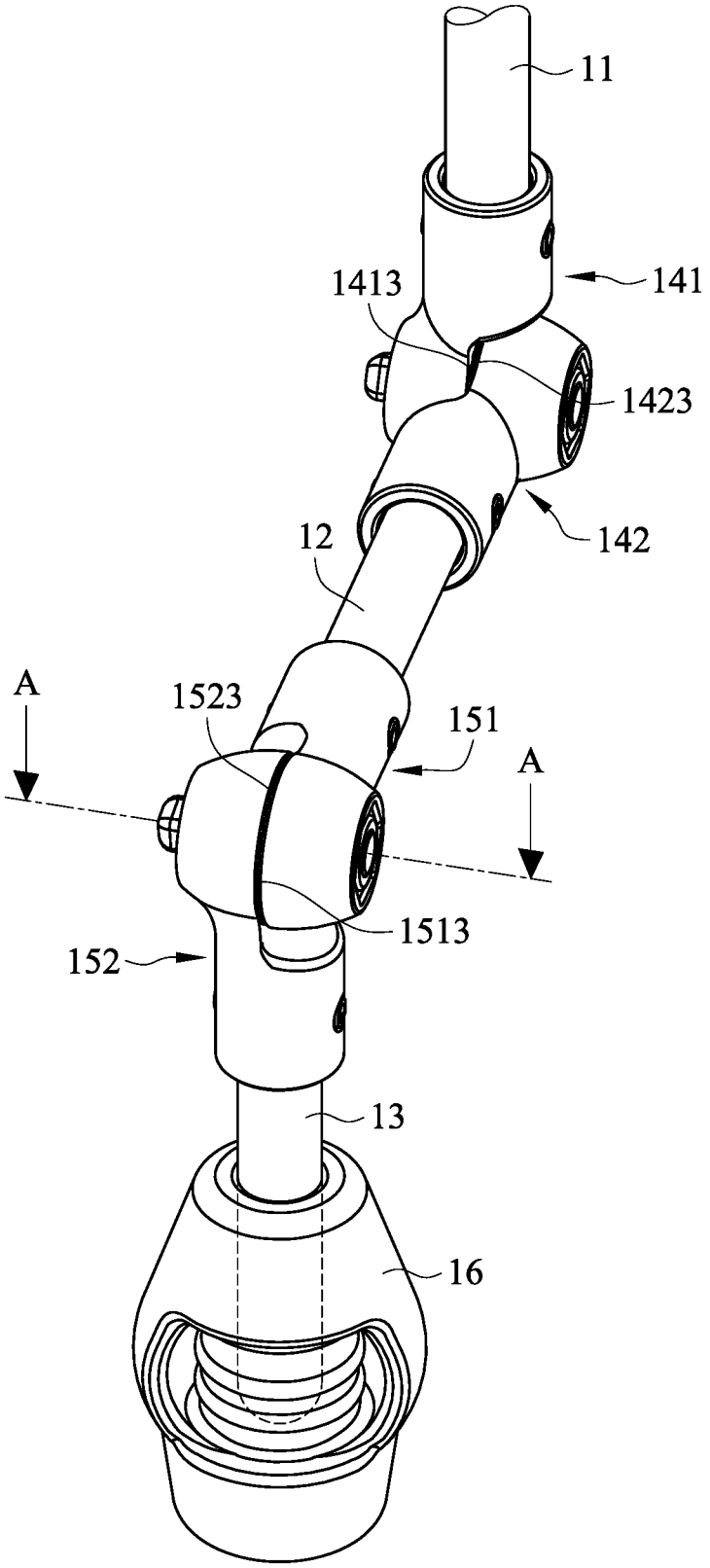
FIG. 3 is a partially perspective view of the drum supporting leg provided by the preferred embodiment of the present invention.
Figure 4:
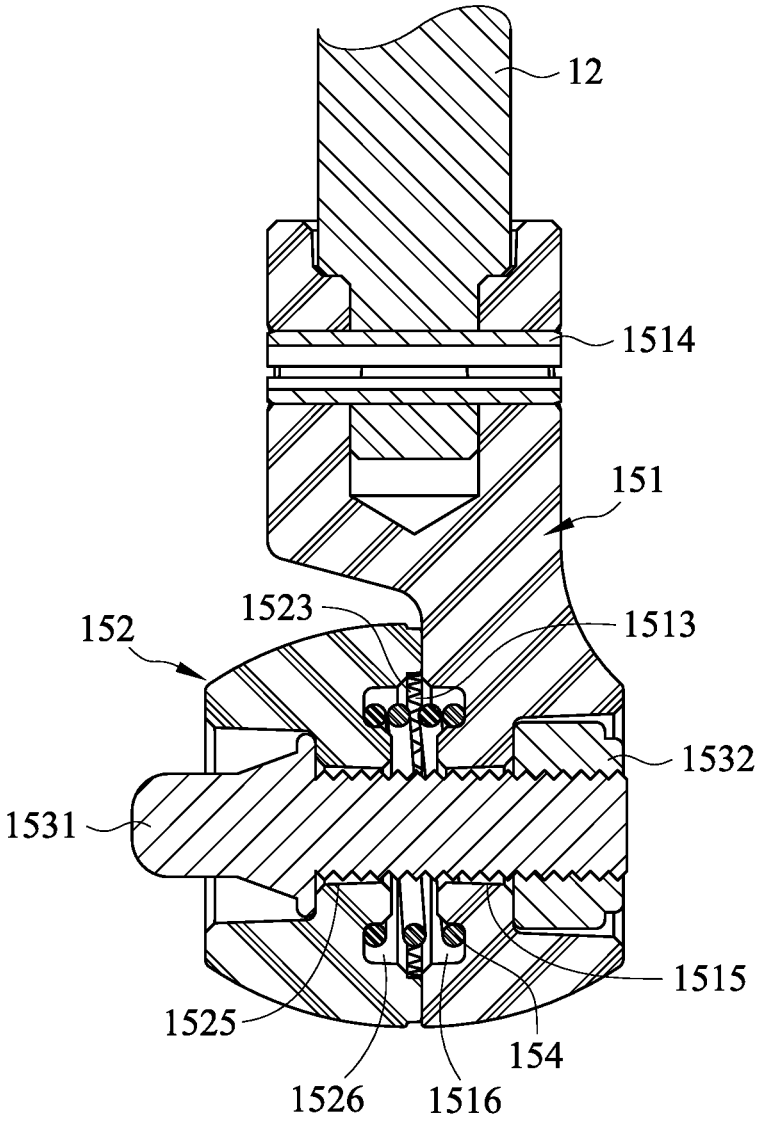
FIG. 4 is a cross-sectional view taken along line A-A of FIG. 3.
Figure 5:
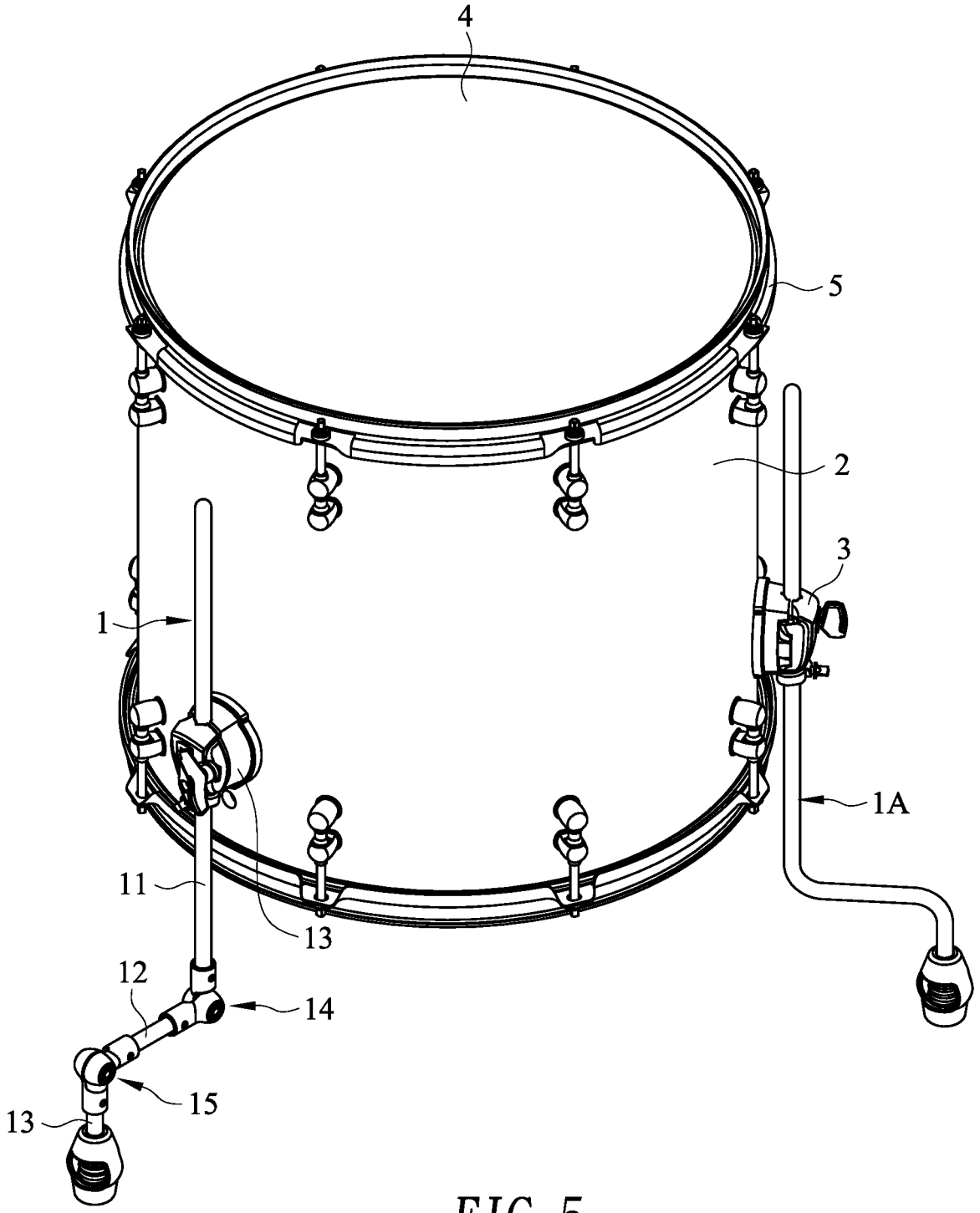
FIG. 5 is a perspective view of the drum supporting leg applied to a drum in accordance with another preferred embodiment of the present invention.

FIG. 1 is a perspective view of a drum supporting leg 1 capable of adjusting an angle in accordance with a preferred embodiment of the present invention. FIG. 2 is an exploded view of the drum supporting leg 1 provided by the preferred embodiment of the present invention. FIG. 3 is a partially perspective view of the drum supporting leg 1 provided by the preferred embodiment of the present invention. FIG. 4 is a cross-sectional view taken along line A-A of FIG. 3. FIG. 5 is a perspective view of the drum supporting leg 1 applied to a drum in accordance with another preferred embodiment of the present invention.

Referring to FIGS. 1-5, by way of example and without limitation, the drum supporting leg 1 of the present embodiment is used for supporting a drum such as, but not limited to, a floor tom or a gong bass drum. The drum supporting leg 1 includes a lower portion to contact the ground or a supporting surface and includes an upper portion to connect the drum.

Referring to FIGS. 1-5, the drum supporting leg 1 mainly includes a first rod 11, a second rod 12, and a third rod 13. A first end 111 (including the upper portion) of the first rod 11 is used to connect the drum. In an embodiment, the drum includes a shell 2, and the first end 111 of the first rod 11 is connected to the outside of the shell 2 through a bracket 3 such that the first rod 11 is axially extended along the outside of the shell 2. In addition, a second end 112 of the first rod 11 is rotatably coupled to a first end 121 of the second rod 12 such that the second rod 12 can be rotated about the second end 112 of the first rod 11. A second end 122 of the second rod 12 is rotatably coupled to a first end 130 of the third rod 13 such that the third rod 13 can rotate about the second end 122 of the second rod 12.

Referring to FIGS. 1-5, in the present embodiment, a first angle-adjusting mechanism 14 is provided between the second end 112 of the first rod 11 and the first end 121 of the second rod 12, and a second angle-adjusting mechanism 15 is provided between the second end 122 of the second rod 12 and the first end 131 of the third rod 13. That is, the second end 112 of the first rod 11 is rotatably coupled to the first end 121 of the second rod 12 via the first angle-adjusting mechanism 14, so that the second rod 12 can rotate about the second end 112 of the first rod 11. The second end 122 of the second rod 12 is rotatably coupled to the first end 131 of the third rod 13 via the second angle-adjusting mechanism 15 such that the third rod 13 can rotate about the second end 122 of the second rod 12.

Referring to FIGS. 1-4, in this embodiment, the first angle-adjusting mechanism 14 includes a first kit 141 and a second kit 142. The first kit 141 includes a first sleeve 1410 coupled with a first annular structure 1412. The first sleeve 1410 is preferably hollow cylindrical and includes a receiving hole 1417 for arranging the second end 112 of the first rod 11. In the present embodiment, the first sleeve 1410 includes an opening 1411, and the second end 112 of the first rod 11 includes a socket 113, and a fixing member 1414, such as a slotted spring pin, is inserted into the socket 113 through the opening 1411. Without limiting the scope of the present invention, the second end 112 of the first rod 11 can be fixed to the first sleeve 1410 in a fitting manner. The fixed mechanism is not limited to the above. Moreover, preferably, the first sleeve 1410 is integrally formed with the first annular structure 1412. A plurality of teeth 1413 are provided at equal intervals around the inner side of the first annular structure 1412. The second kit 142 includes a second sleeve 1420 coupled with a second annular structure 1422. The second sleeve 1420 is preferably hollow cylindrical and has a receiving hole 1427 for arranging the first end 121 of the second rod 12. In this embodiment, the second sleeve 1420 includes an opening 1421, and the first end 121 of the second rod 12 includes a socket 123, and a fixing member 1424, such as a slotted spring pin, is inserted into the socket 123 through the opening 1421. Without limiting the scope of the present invention, the first end 121 of the second rod 12 can be fixed to the second sleeve 1420 in a fitting manner. The fixed mechanism is not limited to the above. A plurality of teeth 1423 are provided at equal intervals around the inner side of the second annular structure 1422. Moreover, preferably, the second sleeve 1420 and the second annular structure 1422 are integrally formed. The teeth 1413 of the first annular structure 1412 engage with the teeth 1423 of the second annular structure 1422.

Referring to FIGS. 1-4, preferably, the inner side of the first annular structure 1412 further includes a first recess 1416, and the inner side of the second annular structure 1422 further includes a second recess 1426. The first recess 1416 and the second recess 1426 constitute an accommodating space, and a first elastic member 144, such as a spring, is disposed in the accommodating space.

In addition, a first fixing member 143 is used for fixing the first kit 141 and the second kit 142. The first fixing member 143 can include, but is not limited to, a bolt 1431 and a nut 1432. Wherein, the bolt 1431 passes through a through hole 1415 of the first annular structure 1412 and a through hole 1425 of the second annular structure 1422, and then is fitted with the nut 1432. When the bolt 1431 is tightened, the relative positions of the teeth 1413 of the first annular structure 1412 and the teeth 1423 of the second annular structure 1422 are locked and cannot be rotated. When the angle between the first rod 11 and the second rod 12 is to be adjusted, the first fixing member 143 must be loosened. When the bolt 1431 of the first fixing member 143 is loosened, the force provided by the first elastic member 144 causes the distance between the teeth 1413 of the first annular structure 1412 and the teeth 1423 of the second annular structure 1422 to increase slightly, so that the relative positions of the teeth 1413 of the annular structure 1412 and the teeth 1423 of the second annular structure 1422 can be changed by rotation. Thus, the second rod 12 can rotate about the second end 112 of the first rod 11 through the second annular structure 1422. In this preferred embodiment, the user can manipulate the second rod 12 to rotate about the second end 112 of the first rod 11, resulting in an angle between the first rod 11 and the second rod 12. In some embodiments of this invention, the angle may range from, but is not limited to, ±0 degrees to ±135 degrees. The degree of angle per adjustment depends on the width of the teeth 1413/1423. In this embodiment, the degree of angle is 5 degrees per adjustment. In other embodiments, different degrees of angle per adjustment can be achieved by employing smaller or larger width of the teeth 1413/1423.

Referring to FIGS. 1-4, in the present embodiment, the second angle-adjusting mechanism 15 includes a third kit 151 and a fourth kit 152. The third set 151 includes a third sleeve 1510 coupled with a third annular structure 1512. The third sleeve 1510 is preferably hollow cylindrical and includes a receiving hole 1517 for arranging the second end 122 of the second rod 12. In this embodiment, the third sleeve 1510 includes an opening 1511, and the second end 122 of the second rod 12 has a socket 124, and a fixing member 1514, such as a slotted spring pin, is inserted into the socket 124 through the opening 1511. Without limiting the scope of the present invention, the second end 122 of the second rod 12 is fixed to the third sleeve 1510 in a fitting manner. The fixing mechanism is not limited to the above. Moreover, preferably, the third sleeve 1510 is integrally formed with the third annular structure 1512. A plurality of teeth 1513 are provided at equal intervals around the inner side of the third annular structure 1512. The fourth kit 152 includes a fourth sleeve 1520 coupled with a fourth annular structure 1522. The fourth sleeve 1520 is preferably a hollow cylinder having a receiving hole 1527 for arranging the first end 131 of the third rod 13. In this embodiment, the fourth sleeve 1520 includes an opening 1521, and the first end 131 of the third rod 13 includes a socket 133, and a fixing member 1524, such as a slotted spring pin, is inserted into the socket 133 through the opening 1521. Without limiting the scope of the present invention, the first end 131 of the third rod 13 can be fixed to the fourth sleeve 1520 in a fitting manner, but the fixing mechanism is not limited to the above. Further, a plurality of teeth 1523 are provided at equal intervals around the inner side of the fourth annular structure 1522. Preferably, the fourth sleeve 1520 and the fourth annular structure 1522 are integrally formed. The teeth 1523 of the fourth annular structure 1522 engage with the teeth 1513 of the third annular structure 1512.

Referring to FIGS. 1-4, preferably, the inner side of the third annular structure 1512 further includes a third recess 1516, and the inner side of the fourth annular structure 1522 further includes a fourth recess 1526. The third recess 1516 and the fourth recess 1526 form an accommodating space, and a second elastic member 154, such as a spring, is disposed in the accommodating space.

Moreover, a second fixing member 153 is provided for fixing the third kit 151 and the fourth kit 152. The second fixing member 153 may include, but is not limited to, a bolt 1531 and a nut 1532; wherein the bolt 1531 passes through a through hole 1525 of the fourth annular structure 1522 and a through hole 1515 of the third annular structure 1512, and then is fixed with the nut 1532. Thereby, when the bolt 1531 is tightened, the relative positions of the teeth 1513 of the third annular structure 1512 and the teeth 1523 of the fourth annular structure 1522 are fixed and cannot be rotated. If the angle between the second rod 12 and the third rod 13 is to be adjusted, the second fixing member 153 must be loosened. When the bolt 1531 of the second fixing member 153 is loosened, the force provided by the second elastic member 154 causes the distance between the teeth 1513 of the third annular structure 1512 and the teeth 1523 of the fourth annular structure 1522 to be slightly increased, so that the relative positions of the teeth 1513 of the third annular structure 1512 and the teeth 1523 of the fourth annular structure 1522 can be changed by rotation. Thereby, the third rod 13 can be rotated around the second end 122 of the second rod 12 through the fourth annular structure 1522. In the preferred embodiment, the user can manipulate the third rod 13 to rotate about the second end 122 of the second rod 12, resulting in an angle between the second rod 12 and the third rod 13. In some embodiments, the angle may range from, but is not limited to, ±0 degrees to ±135 degrees. The degree of angle per adjustment depends on the width of the teeth 1513/1523. In this embodiment, the degree of angle is 5 degrees per adjustment. In other embodiments, different degrees of angle per adjustment can be achieved by employing smaller or larger width of the teeth 1513/1523.

As shown in FIGS. 1-4, in addition, a second end 132 of the third rod 13 may be sleeved with a rubber foot 16. Preferably, the inside and the bottom of the rubber foot 16 are designed to be hollow to improve shock absorption.

FIG. 5 is a perspective view showing a drum, such as a floor tom or a gong bass drum, in accordance with another preferred embodiment of the present invention. As shown in FIG. 5, the drum comprises a shell 2, an upper drumhead 4, an upper hoop 5, a plurality of brackets 3, and a plurality of drum supporting legs 1/1A. Preferably, the shell 2 is hollow cylindrical and includes an upper opening and a lower opening. The upper drumhead 4 is coupled to the upper opening of the shell 2 through the upper hoop 5. A plurality of brackets 3 are fixed to the outer surface of the shell 2, and the number of the brackets 3 is equal to the number of drum supporting legs 1/1 A, preferably three. Each of the brackets 3 is fixed to an upper end (including the upper portion) of the corresponded drum supporting leg 1/1A. The drum supporting leg 1 includes the first rod 11, the second rod 12, the third rod 13, the first angle-adjusting mechanism 14, and the second angle-adjusting mechanism 15, the details of which are as described in the previous embodiment and are omitted for simplicity. In this embodiment, one of the three drum supporting legs is the described supporting leg 1 capable of adjusting angle and the other two are conventional supporting legs 1A with a fixed angle. In another embodiment, all three drum supporting legs are the described drum supporting legs 1 capable of adjusting the angle. In another embodiment, two of the three drum supporting legs are the described supporting legs 1 capable of adjusting angle and the other is a conventional supporting leg 1A with fixed angle. In another embodiment, the drum further includes a lower drumhead and a lower hoop, wherein the lower drumhead couples to and seals the lower opening of the shell through the lower hoop.

Figure 6:
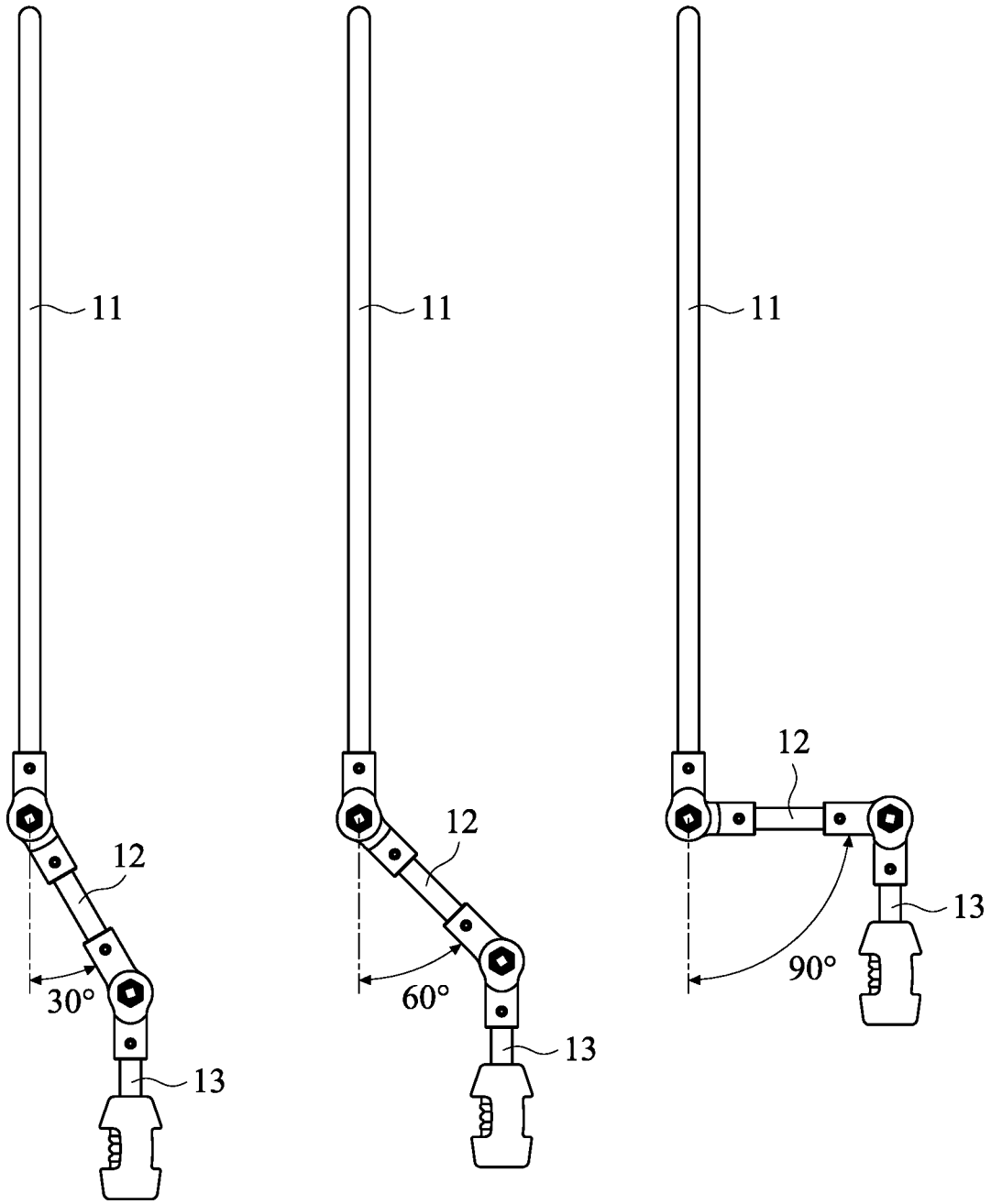
FIG. 6 illustrates that the drum supporting leg can be bent at different angles according to an embodiment of the present invention.

FIG. 6 shows that the drum supporting leg 1 can be bent at different angles according to an embodiment of the present invention. The angle between the first rod 11 and the second rod 12 and the angle between the second rod 12 and the third rod 13 can be rotated to various angles, such as 30 degrees, 60 degrees, 90 degrees, and the like.

Figure 7:
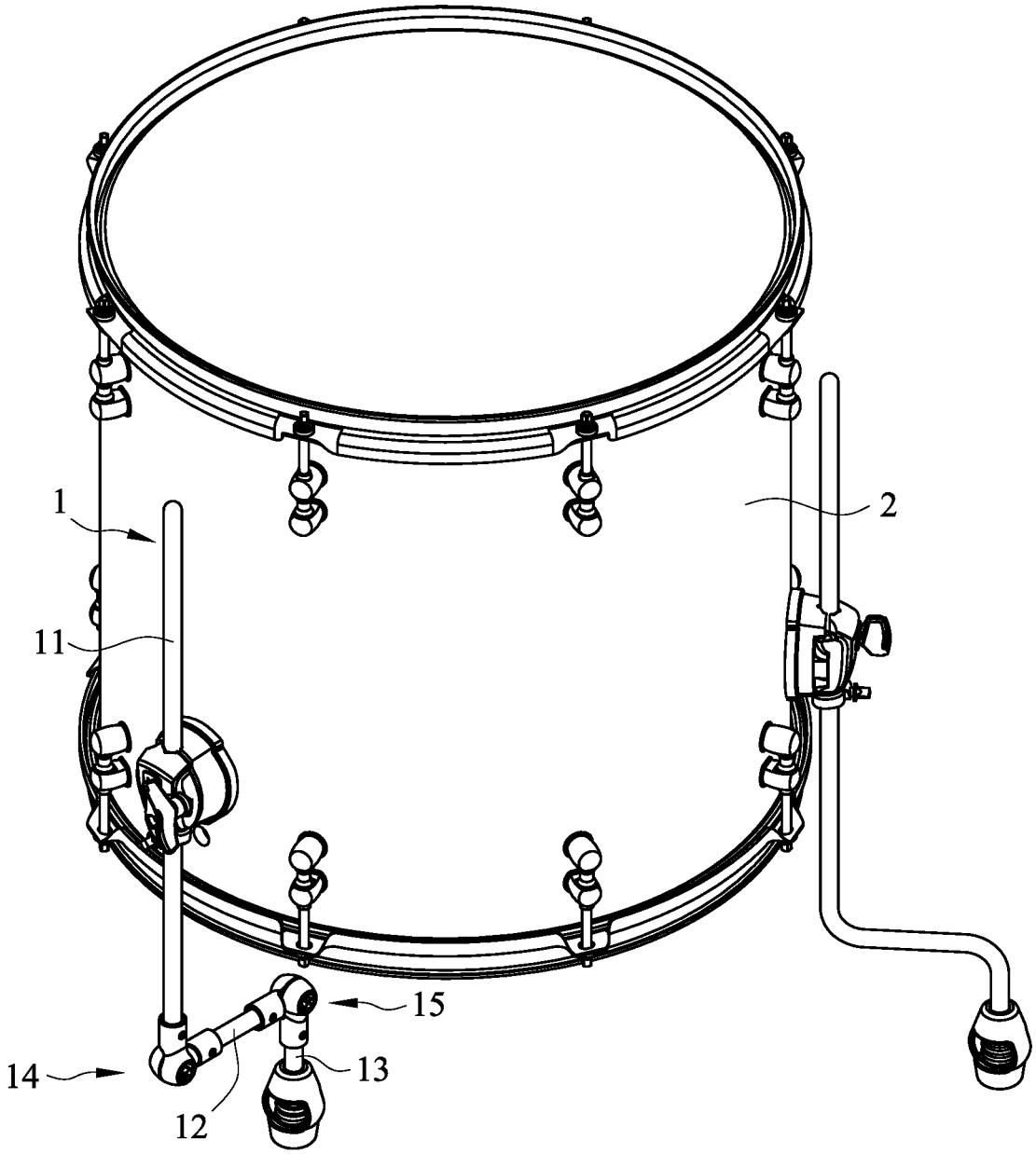
FIG. 7 is a perspective view of a drum according to an embodiment of the present invention.

FIG. 7 shows a drum according to an embodiment of the present invention, wherein at least one of the three drum supporting legs is the described drum supporting leg 1 capable of adjusting the angle, and the second rod 12 of the drum supporting leg 1 is reversely bent. For example, the second rod 12 is reversely bent by 90 degrees so that the second rod 12 and the third rod 13 are located below the shell 2.

According to the drum supporting leg and the drum having the drum supporting leg provided by embodiments of the invention, the drummer can quickly and easily adjust the bending angle of the drum supporting leg to obtain a desired sound, and/or obtain a height that is easy to percuss. The adjustable sound characteristics may include, but are not limited to, sustainability, resonance, reverberation, tone quality, and/or tone color.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A drum supporting leg for supporting a drum and adjusting a sound of the drum, comprising:

a first rod having a first end and a second end, the first end of the first rod being connected to outside of a shell of the drum;

a second rod having a first end and a second end, the first end of the second rod being rotatably coupled to the second end of the first rod such that the first end of the second rod is capable of rotating about the second end of the first rod; and a third rod having a first end and a second end, the first end of the third rod being rotatably coupled to the second end of the second rod such that the first end of the third rod is capable of rotating about the second end of the second rod;

wherein the second end of the first rod is rotatably coupled to the first end of the second rod through a first angle-adjusting mechanism, which comprises:

a first kit comprising a first sleeve and a first annular structure, wherein the first sleeve receives a second end of the first rod and couples with the first annular structure, and an inner side of the first annular structure comprises a plurality of teeth provided at equal intervals; and a second kit comprising a second sleeve and a second annular structure, wherein the second sleeve receives the first end of the second rod and couples with the second annular structure, an inner side of the second annular structure comprises a plurality of teeth provided at equal intervals, and the teeth of the first annular structure engage with the teeth of the second annular structure.

2. The drum supporting leg as recited in claim 1, wherein the first annular structure and the second annular structure form a first accommodating space, and a first elastic member is provided in the first accommodating space, and wherein the drum supporting leg further comprises a first fixing member passing through a center portion of the first annular structure and a center portion of the second annular structure to fix the first annular structure and the second annular structure.

3. The drum supporting leg as recited in claim 1, wherein the first end of the third rod is rotatably coupled to the second end of the second rod through a second angle-adjusting mechanism, which comprises:

a third kit comprising a third sleeve and a third annular structure, wherein the third sleeve receives a second end of the second rod and couples with the third annular structure, and an inner side of the third annular structure comprises a plurality of teeth provided at equal intervals;

a fourth kit comprising a fourth sleeve and a fourth annular structure, wherein the fourth sleeve receives the first end of the third rod and couples with the fourth annular structure, an inner side of the fourth annular structure comprises a plurality of teeth provided at equal intervals, and the teeth of the third annular structure engage with the teeth of the fourth annular structure.

4. The drum supporting leg as recited in claim 3, wherein the third annular structure and the fourth annular structure form a second accommodating space, and a second elastic member is provided in the second accommodating space, and the drum supporting leg further comprises a second fixing member passing through a center portion of the third annular structure and a center portion of the fourth annular structure to fix the third annular structure and the fourth annular structure.

5. A drum, comprising:

a hollow cylindrical shell having an upper opening and a lower opening;

an upper hoop coupling an upper portion of the shell;

a lower hoop coupling a lower portion of the shell;

an upper drumhead coupling with the upper hoop and sealing the upper opening of the shell;

a lower drumhead coupling with the lower hoop and sealing the lower opening of the shell;

a plurality of brackets being fixed to the outside of the shell;

a plurality of drum supporting legs corresponding to the plurality of brackets, wherein at least one of the plurality of drum supporting leg comprises:

a first rod having a first end and a second end, the first end of the first rod being connected to one corresponding bracket;

a second rod having a first end and a second end, the first end of the second rod being rotatably coupled to the second end of the first rod such that the first end of the second rod is capable of rotating about the second end of the first rod; and a third rod having a first end and a second end, the first end of the third rod being rotatably coupled to the second end of the second rod such that the first end of the third rod is capable of rotating about the second end of the second rod;

wherein the second end of the first rod is rotatably coupled to the first end of the second rod through a first angle-adjusting mechanism, which comprises:

a first kit comprising a first sleeve and a first annular structure, wherein the first sleeve receives a second end of the first rod and couples with the first annular structure, and an inner side of the first annular structure comprises a plurality of teeth provided at equal intervals; and a second kit comprising a second sleeve and a second annular structure, wherein the second sleeve receives the first end of the second rod and couples with the second annular structure, an inner side of the second annular structure comprises a plurality of teeth provided at equal intervals, and the teeth of the first annular structure engage with the teeth of the second annular structure.

6. The drum as recited in claim 5, wherein the first annular structure and the second annular structure form a first accommodating space, and a first elastic member is provided in the first accommodating space, and wherein the drum supporting leg further comprises a first fixing member passing through a center portion of the first annular structure and a center portion of the second annular structure to fix the first annular structure and the second annular structure.

7. The drum as recited in claim 5, wherein the first end of the third rod is rotatably coupled to the second end of the second rod through a second angle-adjusting mechanism, which comprises:

a third kit comprising a third sleeve and a third annular structure, wherein the third sleeve receives a second end of the second rod and couples with the third annular structure, and an inner side of the third annular structure comprises a plurality of teeth provided at equal intervals;

a fourth kit comprising a fourth sleeve and a fourth annular structure, wherein the fourth sleeve receives the first end of the third rod and couples with the fourth annular structure, an inner side of the fourth annular structure comprises a plurality of teeth provided at equal intervals, and the teeth of the third annular structure engage with the teeth of the fourth annular structure.

8. The drum as recited in claim 7, wherein the third annular structure and the fourth annular structure form a second accommodating space, and a second elastic member is provided in the second accommodating space, and the drum supporting leg further comprises a second fixing member passing through a center portion of the third annular structure and a center portion of the fourth annular structure to fix the third annular structure and the fourth annular structure.

* * * * *